US012624526B2

(12) United States Patent
Danguchi et al.

(10) Patent No.: US 12,624,526 B2
(45) Date of Patent: May 12, 2026

(54) WORK MACHINE CONTROL SYSTEM, WORK MACHINE, METHOD OF CONTROLLING WORK MACHINE, AND WORK MACHINE CONTROL PROGRAM

(71) Applicant: Yanmar Holdings Co., Ltd., Osaka (JP)

(72) Inventors: Masashi Danguchi, Chikugo (JP); Hiroki Kabata, Chikugo (JP); Naoto Kageyama, Fukuoka (JP)

(73) Assignee: YANMAR HOLDINGS CO., LTD., Osaka (JP)

( * ) Notice: Subject to any disclaimer, the term of this patent is extended or adjusted under 35 U.S.C. 154(b) by 13 days.

(21) Appl. No.: 17/954,073

(22) Filed: Sep. 27, 2022

(65) Prior Publication Data

US 2023/0104700 A1 Apr. 6, 2023

(30) Foreign Application Priority Data

Sep. 27, 2021 (JP) ..... 2021-156455

(51) Int. Cl.

| | |
|---|---|
| ***E02F 9/20*** | (2006.01) |
| ***E02F 9/22*** | (2006.01) |
| ***E02F 9/24*** | (2006.01) |
| ***E02F 9/26*** | (2006.01) |

(52) U.S. Cl.

CPC ..... *E02F 9/2033* (2013.01); *E02F 9/2066* (2013.01); *E02F 9/2235* (2013.01); *E02F 9/2285* (2013.01); *E02F 9/2292* (2013.01); *E02F 9/2296* (2013.01); *E02F 9/24* (2013.01); *E02F 9/262* (2013.01)

(58) Field of Classification Search

CPC ..... E02F 9/2033; E02F 9/2066; E02F 9/2235; E02F 9/2285; E02F 9/2292; E02F 9/2296; E02F 9/24; E02F 9/262; E02F 9/166; E02F 9/2228; E02F 9/2246; E02F 9/2221; H04N 7/181; B60Y 2200/412

See application file for complete search history.

(56) References Cited

U.S. PATENT DOCUMENTS

| | | | | |
|---|---|---|---|---|
| 2018/0258616 | A1* | 9/2018 | Kiyota | G06T 1/00 |
| 2020/0165799 | A1* | 5/2020 | Wu | E02F 9/262 |
| 2022/0303472 | A1* | 9/2022 | Ishida | E02F 9/123 |

FOREIGN PATENT DOCUMENTS

| | | | |
|---|---|---|---|
| EP | 3385457 | A1 | 10/2018 |
| JP | 2014173258 | A | 9/2014 |
| JP | 2021-014737 | A | 2/2021 |
| WO | 2021059615 | A1 | 4/2021 |

OTHER PUBLICATIONS

European Search Report dated Feb. 21, 2023 issued for EP Application No. 22196110.5.

* cited by examiner

*Primary Examiner* — Alan D Hutchinson
(74) *Attorney, Agent, or Firm* — NORTON ROSE FULBRIGHT US LLP

(57) ABSTRACT

A work machine control system is provided with an acquisition process unit and a limit process unit. The acquisition process unit acquires a detection result of an object around a machine body of a work machine in a state incapable of operating the work machine. The limit process unit creates a limit state capable of limitedly operating the work machine, when the detection result meets a predetermined condition and then a gate lock lever is so operated as to create a state capable of operating the work machine.

12 Claims, 8 Drawing Sheets

WORK MACHINE CONTROL SYSTEM, WORK MACHINE, METHOD OF CONTROLLING WORK MACHINE, AND WORK MACHINE CONTROL PROGRAM

CROSS-REFERENCE TO RELATED APPLICATIONS

This application claims priority under 35 U.S.C. § 119 to JP Application No. 2021-156455 filed Sep. 27, 2021, the entire contents of which are hereby incorporated by reference.

TECHNICAL FIELD

The present invention relates to a work machine control system, a work machine, a method of controlling the work machine, and a work machine control program, which are used for a work machine capable of detecting an object around a machine body.

BACKGROUND ART

As a related technology, a work machine control system (controller) for controlling a work machine (hydraulic excavator) is known (see, for example, Patent Document 1). The work machine control system according to the related technology has a target detection function that limits a motion of the work machine based on a result of detection at an ambient monitoring device for detecting whether or not a to-be-recognized target is present within a set area set around the work machine. That is, the work machine control system limits the motion of the work machine when the target detection function detects the target present around the work machine. Then, the work machine control system according to the related technology, with a lock portion (lock lever) switched to a locked state, switches the target detection function to the non-execution setting. When the target detection function is being set to the non-execution, if the lock is switched to the unlocked state and an operation signal from an operation device (operation lever) is detected, the work machine control system switches the target detection function to the execution setting.

PRIOR ART DOCUMENT

Patent Document

Patent Document 1: Japanese Unexamined Patent Application Publication No. 2021-014737

SUMMARY OF INVENTION

Technical Problem

In the above related technology, when the lock portion (lock lever) is switched to the unlocked state and the operation device is further operated, a human operator must carefully operate the operation device so as to prevent the work machine from vigorously operating suddenly, for example.

An object of the present invention is to provide a work machine control system, a work machine, a method of controlling the work machine, and a work machine control program which easily decrease a burden on a human operator related to an operation.

Solution to Problem

A work machine control system according to one aspect of the present invention includes: an acquisition process unit; and a limit process unit. The acquisition process unit acquires a detection result of an object around a machine body of a work machine in a state incapable of operating the work machine. The limit process unit creates a limit state capable of limitedly operating the work machine, when the detection result meets a predetermined condition and then a gate lock lever is so operated as to create a state capable of operating the work machine.

A work machine according to the one aspect of the present invention includes: the work machine control system; and the machine body.

A method of controlling a work machine according to the one aspect of the present invention includes: acquiring a detection result of an object around a machine body of a work machine in a state incapable of operating the work machine; and creating a limit state capable of limitedly operating the work machine, when the detection result meets a predetermined condition and then a gate lock lever is so operated as to create a state capable of operating the work machine.

A work machine control program according to the one aspect of the present invention is a program for causing one or more processors to execute the method of controlling the work machine.

Advantageous Effects of Invention

According to the present invention, it is possible to provide a work machine control system, a work machine, a method of controlling the work machine, and a work machine control program that can easily decrease a burden on a human operator related to an operation.

DESCRIPTION OF EMBODIMENTS

Embodiments of the present invention will be described below with reference to the accompanying drawings. The following embodiments are each an embodied example of the present invention and are not intended to limit the technical scope of the present invention.

First Embodiment

1. Entire Configuration

Figure 1:
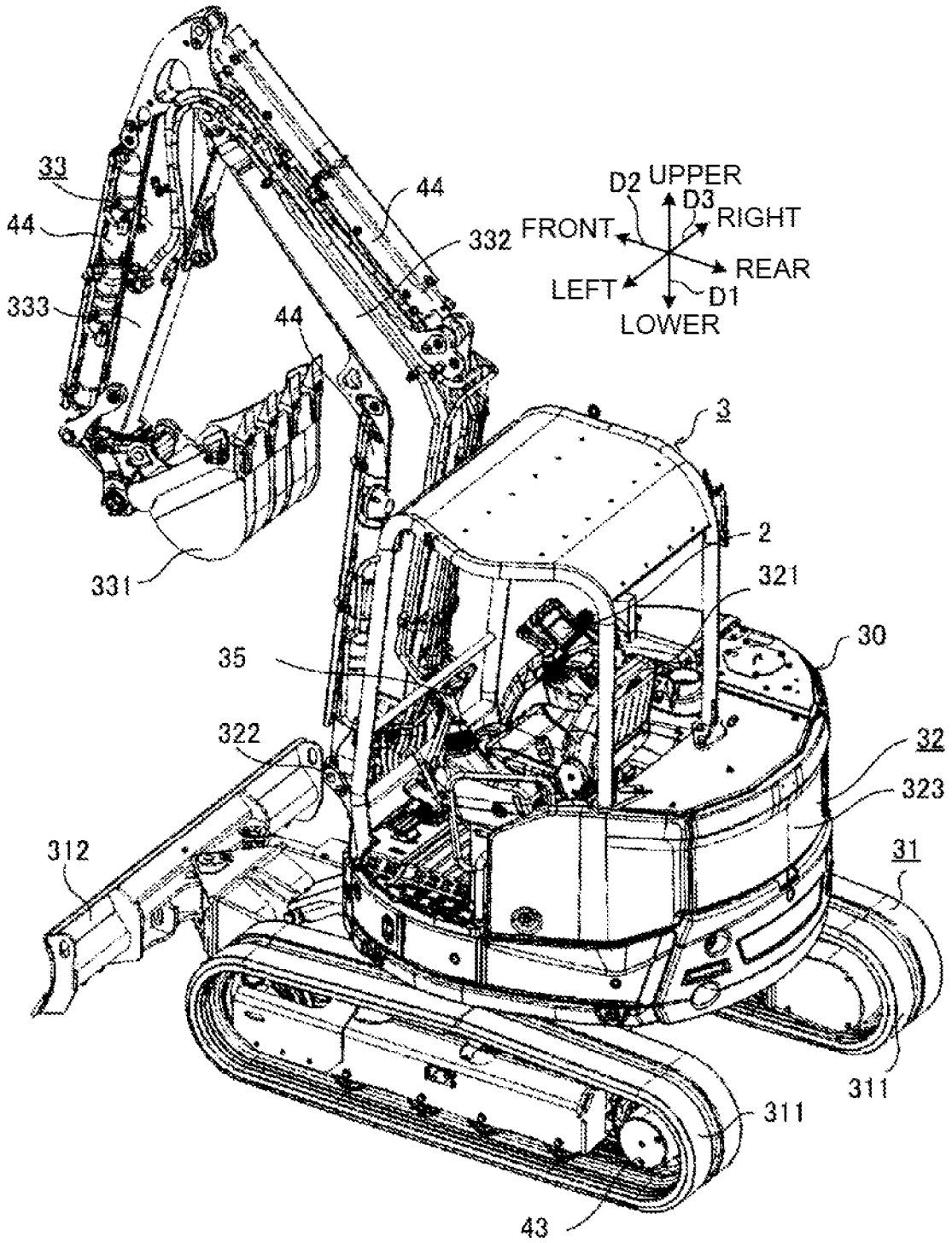
FIG. 1 is a schematic perspective view showing an overall configuration of a work machine according to a first embodiment.
Figure 2:
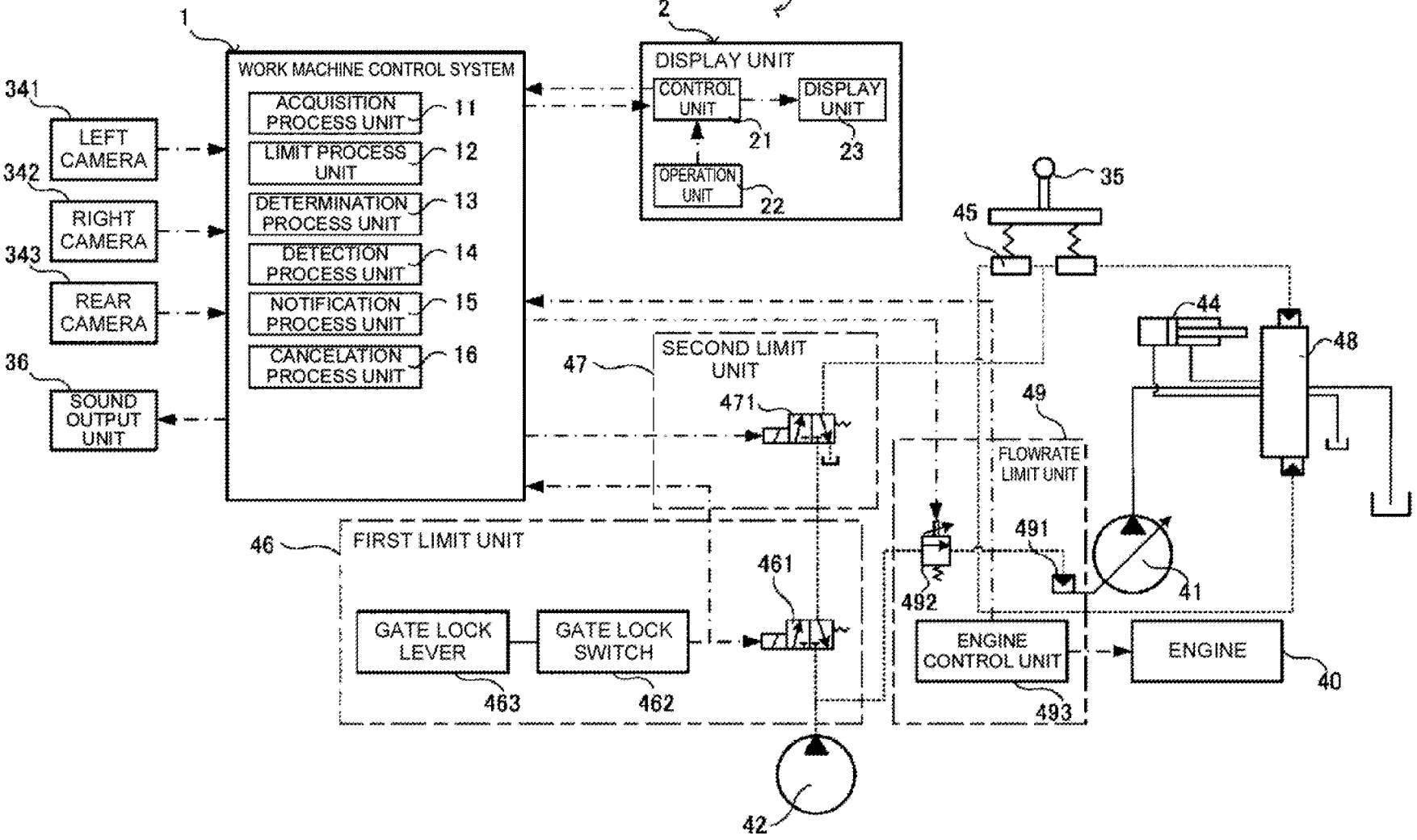
FIG. 2 is a schematic perspective view showing a hydraulic circuit and the like of the work machine according to the first embodiment.

As shown in FIG. 1, a work machine 3 according to the present embodiment includes a machine body 30 having a travel unit 31, a swivel unit 32, and a work unit 33. The work machine 3 further includes a work machine control system 1 (hereinafter, simply referred to as a "control system 1"), as shown in FIG. 2. In addition, as shown in FIGS. 1 and 2, the machine body 30 is further provided with a display unit 2, an activating unit 34, an operation unit 35 and a sound output unit 36.

The "work machine" in the present invention refers to a machine for various types of work, examples thereof including work vehicles such as a backhoe (including a hydraulic excavator and a mini excavator), a wheel loader and a carrier. The work machine 3 is provided with the work unit 33 so configured as to be capable of performing one or more works. The work machine 3 is not limited to a "vehicle" but may be, for example, a work vessel or a flying work body such as a drone or a multi-copter. Further, the work machine 3 is not limited to a construction machine (construction instrument), but may also be an agricultural machine (farm machine) such as a rice transplanter, a tractor or a combine harvester. According to the present embodiment, unless otherwise specified, the case in which the work machine 3 is a riding-type backhoe and can perform digging, land preparation, trenching, or loading operations as its work will be taken as an example.

Further, according to the present embodiment, for convenience of description, a vertical direction in a state where the work machine 3 is usable is defined as an upper-lower direction D1. Further, a front-rear direction D2 and a right-left direction D3 are defined based on a direction viewed from a user (human operator) riding on (a drive unit 321 of) the work machine 3 in a non-swivel state of the swivel unit 32. That is, each direction used in the present embodiment is a direction defined based on the machine body 30 of the work machine 3, and a direction in which the machine body 30 moves when the work machine 3 moves forward is referred to as a "front" and a direction in which the machine body 30 moves when the work machine 3 moves rearward is referred to as a "rear". Similarly, a direction in which a front end portion of the machine body 30 moves when the work machine 3 swivels to the right is referred to as a "right," and a direction in which the front end portion of the machine body 30 moves when the work machine 3 swivels to the left is referred to as a "left". However, these directions are not intended to limit a use direction (a direction in use) of the work machine 3.

The work machine 3 is provided with an engine 40 (see FIG. 2) that serves as a power source. In the present embodiment, as one example, the engine 40 is a diesel engine. The engine 40 is driven by fuel (herein, light oil) supplied from a fuel tank. In the work machine 3, for example, the engine 40 drives a hydraulic pump 41 (refer to FIG. 2), and hydraulic oil is supplied from the hydraulic pump 41 to hydraulic actuators (including hydraulic motor 43, hydraulic cylinder 44 and the like) of portions in the machine body 30 thereby to drive the machine body 30. The above work machine 3 is controlled, for example, by the user (human operator), who is riding on the drive unit 321 of the machine body 30, by operating an operation lever and the like of the operation unit 35.

It is assumed according to the present embodiment that the work machine 3 is a passenger-use backhoe as described above; therefore, the work unit 33 is driven according to the operation performed by the user (human operator) riding on the drive unit 321 thereby to perform work such as excavation work. The drive unit 321, on which the user rides, is disposed on the swivel unit 32.

Here, the drive unit 321 of the machine body 30 is provided with the display unit 2, the operation unit 35, and the sound output unit 36; the user can operate the operation unit 35 while viewing various types of information that is displayed on the display unit 2 and related to the work machine 3. As an example, a display screen of the display unit 2 shows information on an operation status of the work machine 3, such as the cooling water temperature and hydraulic oil temperature, so that the user can check, on the display unit 2, the information that is necessary for operating the operation unit 35 and that is on the operation status of the work machine 3.

The travel unit 31 has a traveling function, and is so configured as to be capable of traveling (including swiveling) on the ground. The travel unit 31 includes, for example, a pair of right and left crawlers 311 and a blade 312. The travel unit 31 further includes a travel-directed hydraulic motor 43 (hydraulic actuator) for driving the crawlers 311.

The swivel unit 32 is located above the travel unit 31 and is so configured as to swivel relative to the travel unit 31 around a rotation axis along the upper-lower direction D1. The swivel unit 32 has a swivel-directed hydraulic motor (a hydraulic actuator). The swivel unit 32 includes, other than the drive unit 321, the engine 40 and the hydraulic pump 41. At the front end portion of the swivel unit 32, a boom bracket 322 on which the work unit 33 is mounted is disposed.

The work unit 33 is so configured as to perform one or more works. The work unit 33 is supported by a boom bracket 322 of the swivel unit 32 and performs works. The work unit 33 has a bucket 331. The bucket 331 is a type of attachment (work instrument) that is mounted on the machine body 30 of the work machine 3, and is composed of an arbitrary instrument selected from among a plurality of types of attachments according to content of the work. The bucket 331, as an example, is removably mounted on the machine body 30, and is replaced according to content of the work. In addition to the bucket 331, the attachments for the work machine 3 include various instruments, such as a breaker, an auger, a crusher, a fork, a fork claw, a steel cutter, an asphalt cutter, a mower, a ripper, a mulcher, a tilt rotator, and a tamper.

The work unit 33 further has a boom 332, an arm 333 and a hydraulic actuator (including hydraulic cylinder 44 and hydraulic motor and the like) and the like. The bucket 331 is mounted to a tip end of the arm 333.

The boom 332 is rotatably supported at the boom bracket 322 of the swivel unit 32. Specifically, the boom 332 is supported at the boom bracket 322 in a manner to rotate about a rotation axis along the horizontal direction. The boom 332 is so shaped as to extend upward from a base end portion supported at the boom bracket 322. The arm 333 is coupled to a tip end of the boom 332. The arm 333 is supported at the boom 332 in a manner to rotate relative to the boom 332 about a rotation axis along the horizontal direction.

The work unit 33 operates under power from the engine 40 as the power source. Specifically, the engine 40 drives the hydraulic pump 41 thereby to supply the hydraulic oil from the hydraulic pump 41 to the hydraulic actuator (hydraulic cylinder 44 or the like) of the work unit 33, thereby to operate portions (the bucket 331, the boom 332, and the arm 333) of the work unit 33.

According to the present embodiment, in particular, the work unit 33 has an articulated configuration in which the boom 332 and the arm 333 are individually rotatable. That is, the boom 332 and the arm 333 each rotate about the rotation axis extending along the horizontal direction, so that the articulated work unit 33 including the boom 332 and the arm 333 is capable of performing motions such as extending and folding as a whole.

Each of the travel unit 31 and the swivel unit 32, as well as the work unit 33, is powered by the engine 40 as the power source. That is, the hydraulic oil is supplied from the hydraulic pump 41 to the hydraulic motor 43 of the travel unit 31, hydraulic motors of the swivel unit 32, and the like, so that the swivel unit 32 and the travel unit 31 are operated.

Figure 3:
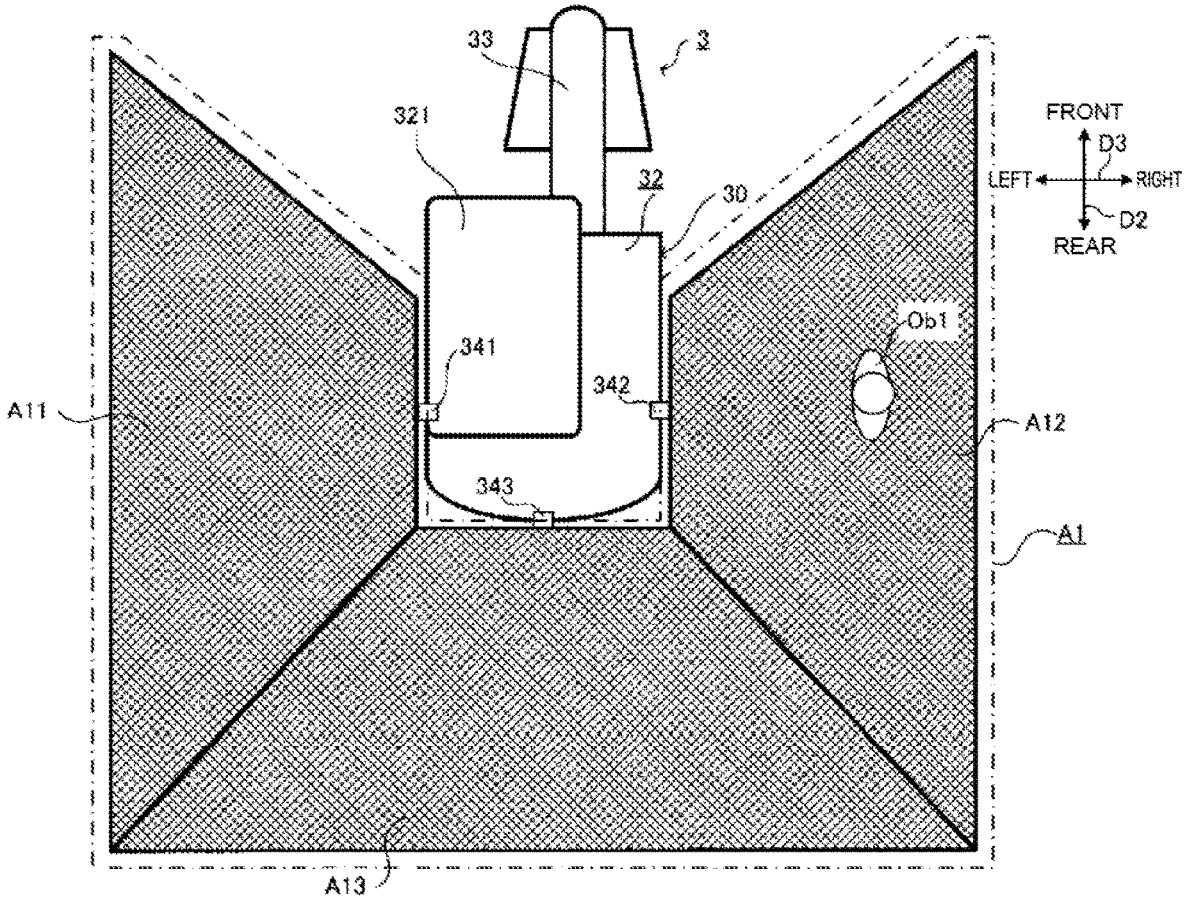
FIG. 3 is a schematic plan view of the work machine according to the first embodiment, viewed from above, schematically showing a monitor area and the like set up around the work machine.

The machine body 30 is provided with various sensors (including cameras) so as to detect an object Ob1 (see FIG. 3) in a monitor area A1 (see FIG. 3) around the work machine 3, such as a camera to capture an image around the machine body 30. In the present embodiment, as one example, as shown in FIG. 3, a plurality of cameras (herein, three cameras), including a left camera 341, a right camera 342 and a rear camera 343, are mounted on the swivel unit 32 of the machine body 30. The left camera 341, the right camera 342 and the rear camera 343 are connected to the control system 1 and output, to the control system 1, images captured by each camera. FIG. 3 is a plan view of the work machine 3 viewed from above, schematically showing the monitor area A1 set up around the work machine 3, the object Ob1, and the machine body 30 (including the left camera 341, right camera 342 and rear camera 343) of the work machine 3.

The left camera 341, the right camera 342, and the rear camera 343 are installed to face left, right, and rear, respectively, based on the drive unit 321, so as to capture images of the monitor area A1 on left, right, and rear viewed from the human operator riding on the drive unit 321 of the swivel unit 32. That is, as shown in FIG. 3, the monitor area A1 includes a plurality (in this case, three) of small areas A11, A12, and A13, and the left camera 341 captures an image of the small area A11 (left area) which is on the left as seen from the human operator riding on the drive unit 321. Similarly, the right camera 342 captures an image of the small area A12 (right area) which is on the right as seen from the human operator riding on the drive unit 321, and the rear camera 343 captures an image of the small area A13 (rear area) which is in the rear as seen from the human operator riding on the drive unit 321. This enables the left camera 341, the right camera 342, and the rear camera 343 to cover the both sides (left and right) and the rear which are often blind spots for the human operator.

FIG. 2 schematically shows a hydraulic circuit and an electric circuit (electric connection) of the work machine 3 according to the present embodiment. In FIG. 2, solid lines indicate high-pressure oil paths (for hydraulic oil), dotted lines indicate low-pressure oil paths (for pilot oil), and dashed-dotted lines indicate electric signal paths.

As shown in FIG. 2, the work machine 3 has the hydraulic pump 41, the hydraulic motor 43 (omitted from FIG. 2) and the hydraulic cylinder 44, as well as a pilot pump 42, a remote control valve 45, a first limit unit 46, a second limit unit 47, a direction switch valve (control valve) 48, a flowrate limit unit 49 and the like.

The hydraulic oil from the hydraulic pump 41 driven by the engine 40 is supplied to the hydraulic motor 43 of the travel unit 31, the hydraulic motor of the swivel unit 32, the hydraulic cylinder 44 of the work unit 33, and the like. This drives the hydraulic actuators such as the hydraulic motor 43 and the hydraulic cylinder 44.

Here, the flowrate of the hydraulic oil supplied from the hydraulic pump 41 is not fixed, but can be changed (variable) by an appropriate measure. The work machine 3 according to the present embodiment is provided with the flowrate limit unit 49, making it possible to adjust the flowrate of the hydraulic fluid at the flowrate limit unit 49. In the present embodiment, as one example, the hydraulic pump 41 includes a variable displacement pump that can change the hydraulic oil volume discharged per revolution of a drive shaft.

The flowrate limit unit 49 has a control signal input port 491, a solenoid proportional valve 492, and an engine control unit 493. The control signal input port 491 is a port where a control signal is input so as to adjust the discharge rate (flowrate) of the hydraulic oil of the hydraulic pump 41 composed of the variable displacement type pump. Specifically, pilot oil, which serves as the control signal, is supplied from the pilot pump 42 to the control signal input port 491, and the discharge rate of the hydraulic oil of the hydraulic pump 41 changes according to the supply rate (pilot pressure) of the pilot oil. The solenoid proportional valve 492 is an electromagnetic proportional control valve installed on the pilot oil supply path to the control signal input port 491, and adjusts the pilot pressure input to the control signal input port 491. The solenoid proportional valve 492 is connected to the control system 1, and according to the control signal (supply current) from the control system 1, adjusts the pilot pressure input to the control signal input port 491, thereby to change the discharge rate of the hydraulic oil of the hydraulic pump 41. The engine control unit 493 controls the speed of the engine 40. That is, the engine control unit 493 controls the speed of the hydraulic pump 41 thereby to change the discharge rate of the hydraulic oil of the hydraulic pump 41.

Thus, the flowrate limit unit 49 controls at least one of the flowrate of the hydraulic pump 41 that supplies the hydraulic oil, the speed of the engine 40 that drives the hydraulic pump 41, and the pilot pressure, thereby making it possible to adjust the flowrate of the hydraulic oil discharged from the hydraulic pump 41. The flowrate limit unit 49 may, without steps, continuously vary the flowrate of the hydraulic fluid discharged from the hydraulic pump 41, or may vary the flowrate in steps (for example, 2, 5, or 10 steps).

Each of the hydraulic actuators, such as the hydraulic motor 43 and the hydraulic cylinder 44, includes a pilot-type direction switch valve 48 capable of switching a direction and flowrate of the hydraulic oil from the hydraulic pump 41. The direction switch valve 48 is driven when the pilot oil serving as an input instruction is supplied from the pilot pump 42.

Here, the remote control valve 45 is disposed in the pilot oil's supply path to the direction switch valve 48 that corresponds to the hydraulic cylinder 44 of the work unit 33. The remote control valve 45 outputs a work operation instruction of the work unit 33 according to the operation of the operation unit 35 (operation lever). The work operation instruction instructs an expanding operation, a contracting operation and the like of the work unit 33. The flowrate of the pilot oil supplied from the pilot pump 42 to the remote control valve 45 is adjustable at the first limit unit 46 and the second limit unit 47. The first limit unit 46 has a first control valve 461, a gate lock switch 462 and a gate lock lever 463. The second limit unit 47 has a second control valve 471.

The first control valve 461 and the second control valve 471 are each an electromagnetic control valve (solenoid valve), and are inserted in series between the remote control valve 45 and the pilot pump 42. The first control valve 461 is connected via the gate lock switch 462 to the power supply, and operates according to the current supplied from the power source. The second control valve 471 is connected to the control system 1, and operates according to the control signal (supply current) from the control system 1. The first control valve 461 and the second control valve 471 are each a (electromagnetic) proportional control valve, however, can also be a switchable open/close valve that opens/closes the flow path, for example.

The first control valve 461 and the second control valve 471 each in an energized state, that is, when the current as the control signal is supplied, open the flow path of the pilot oil, and in a de-energized state, that is, when the current as the control signal is shut off, shut off the flow path of the pilot oil. Therefore, shutting off the supply current (control signal) to at least one of the first control valve 461 and the second control valve 471 disenabling the hydraulic actuator (hydraulic cylinder 44 and the like) that corresponds to the remote control valve 45, thus forcibly stopping the hydraulic actuator not depending on the operation of the operation unit 35.

Similarly, a remote control valve is also disposed in the pilot oil's supply path to a direction switch valve that corresponds to the hydraulic motor 43 of the travel unit 31. This remote control valve outputs a travel operation instruction of the travel unit 31 according to the operation of the operation unit 35 (operation lever). The travel operation instruction instructs a traveling operation (for example, forward or backward) of the travel unit 31. Further, a remote control valve is also disposed in the pilot oil's supply path to a direction switch valve that corresponds to the hydraulic motor of the swivel unit 32. This remote control valve outputs a swivel operation instruction of the swivel unit 32 according to the operation of the operation unit 35 (operation lever). The swivel operation instruction instructs a swivel operation (for example, left swivel or right swivel) of the swivel unit 32. And, to between these remote control valves and the pilot pump 42, the first control valve 461 and the second control valve 471 are inserted.

The gate lock switch 462 is interlocked with the gate lock lever 463. The gate lock lever 463 is located in the drive unit 321 of the machine body 30, and receives an operation input by the user (human operator). In the present embodiment, as one example, the gate lock lever 463 is operable along the upper-lower direction D1. When the gate lock lever 463 is in "up position" which is the upper end position of the movable range, the gate lock switch 462 is "off"; and when the gate lock lever 463 is in "down position" which is the lower end position of the movable range, the gate lock switch 462 is "on". The gate lock switch 462 is connected to the control system 1, and the gate lock switch 462 on or off is monitored by the control system 1.

Therefore, when the gate lock lever 463 is in "down position", the first control valve 461 is brought in the energized state, driving the hydraulic actuator (hydraulic cylinder 44 and the like) by the operation of the operation unit 35. In contrast, when the gate lock lever 463 is in the "up position", the first control valve 461 is brought in the de-energized state, forcibly stopping the hydraulic actuator not depending on the operation of the operation unit 35. Therefore, to drive the hydraulic actuator (such as hydraulic cylinder 44), the user (human operator) needs to operate the gate lock lever 463 to "down position".

Further, each of the swivel unit 32 and the travel unit 31 operates with the hydraulic oil supplied from the hydraulic pump 41 to the hydraulic actuator (hydraulic motor 43 and the like); therefore, when the gate lock lever 463 is in the "up position", the swivel unit 32 and travel unit 31 also become inoperable. That is, when the gate lock lever 463 is in the "up position", all of the work unit 33, the swivel unit 32, and the travel unit 31 are forcibly disenabled.

In short, the gate lock switch 462, when being off, is in a "locked state" in which the motion of the work machine 3 is limited (including prohibited), and when being on, is in an "unlocked state" in which the motion of the work machine 3 is not limited. Then, when the gate lock lever 463 is in "up position" and the gate lock switch 462 is in the locked state (off), the motion of the work machine 3 is forcibly limited not depending on the operation of the operation unit 35. The gate lock lever 463 is thus the lever operated so as to lock the motion of the work machine 3, and is synonymous with a cutoff lever.

The operation unit 35 is located in the drive unit 321 of the machine body 30, and is a user interface for receiving the operation input by the user (human operator). The operation unit 35 outputs an electrical signal (operation signal) that accords to the operation by the user, for example, thereby to receive various operations by the user.

The sound output unit 36 outputs a sound (including voice) to the user (human operator). The sound output unit 36 includes a buzzer or a speaker, and outputs the sound upon receiving an electric signal. The sound output unit 36 is connected to the control system 1, and outputs sounds, such as beeps or voice, according to a sound control signal from the control system 1. According to the present embodiment, the sound output unit 36, as well as the display unit 2, is disposed in the drive unit 321 of the machine body 30. The sound output unit 36 may be disposed integrally with the display unit 2.

The control system 1 is mainly composed of a computer system having one or more processors such as a CPU (Central Processor), and one or more memories such as a ROM (Read Only Memory) or a RAM (Random Access Memory), and executes various processes (information process). According to the present embodiment, the control system 1 is an integrated control unit that controls the entire work machine 3, and is configured by, for example, an electronic control unit (ECU). However, the control system 1 may be separate from the integrated control unit, and may primarily include one processor or a plurality of processors. The control system 1 will be described in detail in the column "[2] Configuration of Control System".

The display unit 2 is disposed in the drive unit 321 of the machine body 30, and is a user interface for receiving the operation input by the user (the human operator) and outputting various types of information to the user. The display unit 2 outputs an electric signal that accords to the operation by the user, for example, thereby to receive various operations performed by the user. Accordingly, the user (the human operator) can view a display screen Dp1 (refer to FIG. 4) displayed on the display unit 2, and can operate the display unit 2 as necessary.

As shown in FIG. 2, the display unit 2 includes a control unit 21, an operation unit 22, and a display unit 23. The display unit 2 is so configured as to be communicable with the control system 1, and can perform sending and receiving of data to and from the control system 1. In the present embodiment, as one example, the display unit 2 is a dedicated device used for the work machine 3.

The control unit 21 controls the display unit 2 according to data from the control system 1. Specifically, the control unit 21 outputs an electric signal that accords to the user's operation received by the operation unit 22, and displays, in the display unit 23, the display screen Dp1 generated by the control system 1.

Figure 4:
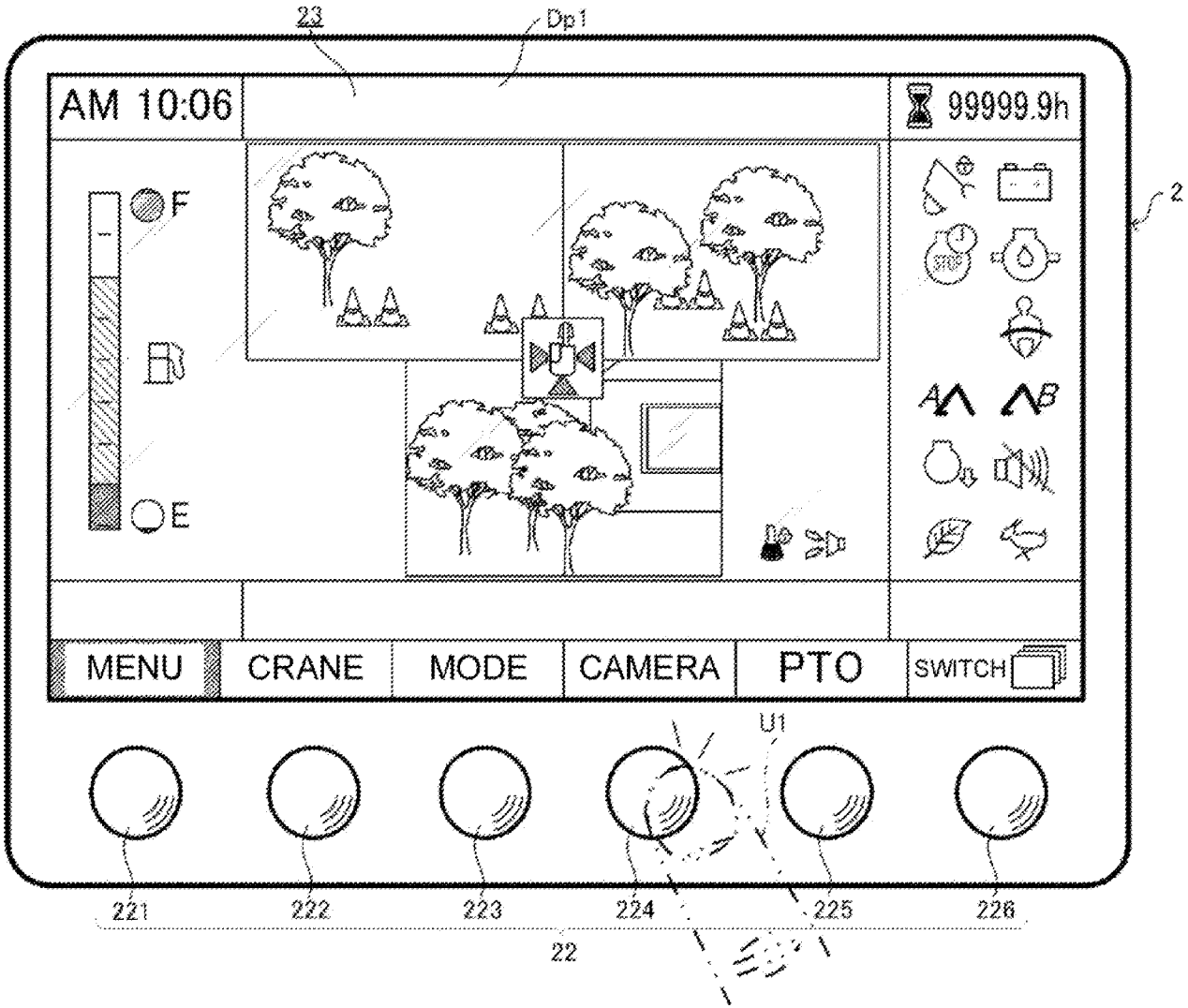
FIG. 4 is a schematic external view of a display unit on which a display screen is displayed by a work machine control system according to the first embodiment.

The operation unit 22 is a user interface for receiving the user (human operator)'s operation input to the display screen Dp1 displayed in the display unit 23. The operation unit 22 receives various operations by a user U1 (refer to FIG. 4), for example, by outputting the electric signal that accords to the operation by the user U1. In the present embodiment, as one example, the operation unit 22 includes a plurality (herein six) of mechanical push button switches 221 to 226 as shown in FIG. 4. The plurality of push button switches 221 to 226 is disposed in the vicinity of a display region of the display unit 23 (a lower portion in the example in FIG. 4) along a periphery of the display region. The plurality of push button switches 221 to 226 each is associated with an item that is displayed on the display screen Dp1 and that is described below, and operating any of the plurality of push button switches 221 to 226 operates (selects) any of the item on the display screen Dp1.

Further, the operation unit 22 may include a touch screen and an operation dial. Also in this case, operating for the operation unit 22 operates (selects) any of the item on the display screen Dp1.

The display unit 23 is a user interface for displaying information to the user U1 (the human operator), such as a liquid crystal display or an organic EL display that displays various types of information. The display unit 23 presents various types of information to the user by means of display. In the present embodiment, as one example, the display unit 23 is a full-color liquid crystal display with a backlight, and has a "horizontally-long" display area that is long in a horizontal direction as shown in FIG. 4.

In addition to the above configuration, the machine body 30 is further provided with a communication terminal, a fuel tank and a battery. Further, the machine body 30 is provided with various sensors (including cameras) for detecting a to-be-detected object in the monitor area around the work machine 3, such as a camera for capturing an image around the machine body 30.

2. Configuration of Control System

Next, a configuration of the control system 1 according to the present embodiment will be described with reference to FIG. 2. The control system 1 controls each portion of the machine body 30 (including the travel unit 31, the swivel unit 32, and the work unit 33 and the like). According to the present embodiment, the control system 1 is a component of the work machine 3, constituting the work machine 3 together with the machine body 30 and others. That is, the work machine 3 is provided with at least the control system 1 and the machine body 30.

As shown in FIG. 2, the control system 1 is provided with an acquisition process unit 11, a limit process unit 12, a determination process unit 13, a detection process unit 14, a notification process unit 15, and a cancelation process unit 16. In the present embodiment, as one example, the control system 1 is mainly composed of a computer system having at least one processor; therefore at least one processor, by executing a work machine control program, realizes the plurality of functional portions (the acquisition process unit 11 and the like). The plurality of functional portions included in the control system 1 may be distributed to a plurality of cases or may be included in a single case.

The control system 1 is so configured as to be communicable with a device included in each portion of the machine body 30. This means that, to the control system 1, at least the display unit 2, the left camera 341, the right camera 342, the rear camera 343, the sound output unit 36, the gate lock switch 462, the second control valve 471, the solenoid proportional valve 492, the engine control unit 493 and the like are connected. This causes the control system 1 to control the display unit 2, the sound output unit 36 and the like, and to acquire the image captured by the left camera 341, the right camera 342, the rear camera 343 and the like. Here, the control system 1 may send and receive various types of information (data) directly to and from each device, or indirectly through a relay or the like. The control system 1 and the device that is disposed in each portion of the machine body 30 can communicate with each other by a communication method such as CAN (Control unit Area Network) or the like, as one example.

The acquisition process unit 11, at least in a state incapable of operating the work machine 3, executes the acquisition process to acquire the detection result of the object Ob1 around the machine body 30 of the work machine 3. Specifically, according to the present embodiment, the object Ob1 around the machine body 30 is detected by the detection process unit 14 based on output of the left camera 341, right camera 342, and rear camera 343. Therefore, from the detection process unit 14, the acquisition process unit 11 acquires the detection result of the object Ob1 around the machine body 30. In the present embodiment, as one example, the object Ob1 is a "person". That is, when the "person" enters the monitor area A1 around the work machine 3 as a result of the work machine 3 moving or the "person" around the work machine 3 moving, the detection process unit 14 detects the "person" as the object Ob1. When a plurality of objects Ob1 is present in the monitor area A1, the detection process unit 14 may perform the detection including the number of objects Ob1 (number of persons).

"the state incapable of operating the work machine 3" here means a state where the work machine 3 is not driven by the operation of the operation unit 35, and includes at least the state where the gate lock lever 463 is in "up position" and the gate lock switch 462 is off. Further, "the state incapable of operating the work machine 3" includes, for example, a state where an ignition of the work machine 3 is off (that is, the engine 40 is stopped) and a state where the main power of the work machine 3 is off. Conversely, "the state capable of operating the work machine 3" means a state where the work machine 3 is driven by the operation of the operation unit 35, and includes at least a state where the gate lock lever 463 is in "down position" and the gate lock switch 462 is on. Further, "the state capable of operating the work machine 3" includes, for example, a state where the ignition of the work machine 3 is on (that is, the engine 40 is driving) and the main power supply of the work machine 3 is on. In the present embodiment, as one example, the state where the gate lock lever 463 is in "up position" is the "state in capable of operating the work machine 3" and the state where the gate lock lever 463 is in "down position" is "the state capable of operating the work machine 3".

That is, the acquisition process unit 11 has the function of acquiring the detection result of the object Ob1 around the machine body 30 in the state where at least the gate lock lever 463 is in "up position". However, according to the present embodiment, the acquisition process unit 11 acquires the detection result of the object Ob1 around the machine body 30, not limited to in the state incapable of operating the work machine 3, but also in the state capable of operating the work machine 3. That is, regardless of whether the gate lock lever 463 is in "up position" or "down position", the acquisition process unit 11, from the detection process unit 14, regularly or irregularly acquires the detection result of the object Ob1 around the machine body 30. When distinguishing between the detection result acquired in "the state incapable of operating the work machine 3" and the detection result acquired in "the state capable of operating the work machine 3", the former is referred to as "at-stop detection result" and the latter is referred to as "at-steady-state detection result".

The limit process unit 12 executes a limit process that creates a limit state capable of limitedly operating the work machine 3, when the detection result (at-stop detection result) acquired in the state incapable of operating the work machine 3 meets a predetermined condition and then the lever 463 is so operated as to create the state capable of operating the work machine 3. That is, in the state incapable of operating the work machine 3 (the gate lock lever 463 is in "up position")" and the detection result acquired by the acquisition process unit 11 meets the predetermined condition, the gate lock lever 463, when operated from "up position" to "down position", causes the limit process unit 12 to create the limit state capable of limitedly operating the work machine 3.

The "predetermined condition" here is a condition imposed on the detection result (at-stop detection result) so as to create the limit state capable of limitedly operating the work machine 3 (to execute the limit process), and includes, for example, the object Ob1 being present in the monitor area A1 around the machine body 30. The "predetermined condition" is, for example, in addition to or instead of the object Ob1 being present in the monitor area A1, that the object Ob1 has a specific attribute, the object Ob1 is present in the monitor area A1 for more than or equal to a predetermined time period, a specific position around the machine body 30 (for example, a position in the operator's blind spot, or a position within a certain distance from the machine body 30), or the like. The "specific attribute" here includes, as an example, that the object Ob1 is moving, that object Ob1 is other than a worker (a general person), that there are more than or equal to a predetermined number of objects Ob1, or the like. In the present embodiment, as one example, the "predetermined condition" is the object Ob1 (in this case, "person") being present in the monitor area A1.

The "limit state" here means the limit state capable of limitedly operating the work machine 3, not a state incapable of operating the work machine 3 at all, but a state capable of operating the work machine 3 with some limit imposed. As an example, the "limit state" includes a state capable of operating the work machine 3 only within a certain time, a state capable of operating the work machine 3 only within a certain distance, a state limiting the motion speed of the hydraulic actuator, a state limiting the operation target (specific hydraulic actuator, etc.), a state inhibiting a specific operation such as swiveling and expanding of the work machine 3, or a combination thereof.

In short, when the at-stop detection result meets the predetermined condition with the object Ob1 (in this case, the "person") being present in the monitor area A1 in the state incapable of operating the work machine 3, operating the gate lock lever 463 from "up position" to "down position" causes the limit process unit 12 to put the work machine 3 in the limit state. With this, the state of the work machine 3 switches from a state incapable of operating even when the operation unit 35 is operated to a state capable of operating according to the operation of the operation unit 35 despite some limit imposed.

The determination process unit 13 determines whether "the state incapable of operating the work machine 3" or "the state capable of operating the work machine 3", and whether or not the at-stop detection result meets the predetermined condition. That is, the determination process unit 13 determines, based on at least the input signal from the gate lock switch 462, whether the gate lock lever 463 is in "up position" or "down position". When the gate lock switch 462 is off, the determination process unit 13 determines that the gate lock lever 463 is in "up position", i.e., in "the state incapable of operating the work machine 3". The determination process unit 13 outputs the determination result to at least the limit process unit 12. With this, in the limit process unit 12, operating the gate lock lever 463 to "down position" when the at-stop detection result meets the predetermined condition creates the limit state capable of limitedly operating the work machine 3.

The detection process unit 14 detects the object Ob1 in the monitor area A1 around the machine body 30. That is, the detection process unit 14 determines whether or not the object Ob1 is present in the monitor area A1, and outputs a detection result showing whether or not the object Ob1 is present in the monitor area A1. Specifically, according to the present embodiment, the detection process unit 14 regularly or irregularly acquires outputs of the left camera 341, the right camera 342 and the rear camera 343 from the left camera 341, the right camera 342 and the rear camera 343. That is, the detection process unit 14 acquires the image data of the monitor area A1 (each of small areas A11, A12, A13) around the work machine 3. The data acquired by the detection process unit 14 is stored in a memory, for example. Then, the detection process unit 14 detects the object Ob1 in the monitor area A1, based on the outputs (image data) of the left camera 341, the right camera 342 and the rear camera 343.

Specifically, the detection process unit 14 applies the image process to the acquired image data thereby to extract a feature quantity in the image, and based on the feature quantity, determines whether or not the object Ob1 ("person" according to the present embodiment) is reflected in the image. Here, when the object Ob1 is reflected in the image, the detection process unit 14 determines the object Ob1 is reflected in the image captured by which of the left camera 341, the right camera 342 and the rear camera 343. That is, the detection process unit 14 distinguishes the object Ob1 is present in which of the small area A11 imaged by the left camera 341, the small area A12 imaged by the right camera 342, and the small area A13 imaged by the rear camera 343, thereby to detect the object Ob1.

The notification process unit 15 executes a notification process that provides a notification that is based on the detection result of the detection process unit 14, i.e., the detection result of the object Ob1 in the monitor area A1 around the machine body 30. "The notification" as used in the present disclosure means a notification to the user (human operator) by various measures, including, for example, sound (including voice), display (including lighting of display light), sending to another terminal, or writing in a non-transient recording medium. In the present embodiment, as one example, when the object Ob1 is present in the monitor area A1 around the machine body 30, the notification process unit 15 causes the display unit 23 of the display unit 2 to show a display to that effect, and causes the sound output unit 36 to output a notification sound. The notification sound may be a simple beep, or a voice such as a message "Please be careful". Further, the notification content (display content and notification sound) may vary according to the detection result (position of the object Ob1, distance from the machine body 30 to the object Ob1, and the like) of the detection process unit 14.

In the limit state, when at least one of the detection item related to the (at-stop) detection result and the operation item related to the operation state of the work machine 3 meets the cancelation condition, the cancelation process unit 16 executes the cancelation process so as to end the limit state. When the limit process is executed by the limit process unit 12 and the work machine 3 is in the limit state, at least one of the detection item and the operation item, if meeting the cancelation condition, causes the cancelation process unit 16 to end the limit state. When the limit state ends, the state of the work machine 3 (or the control system 1) transitions to "the state incapable of operating the work machine 3" or "the state capable of operating the work machine 3". In the present embodiment, as one example, the process, after the end of the limit state, shall transition to the state incapable of operating the work machine 3.

The "detection item" here includes various items related to the at-stop detection result, such as the at-stop detection result itself, such as the object Ob1 being present or not, and the left camera 341, right camera 342, and rear camera 343's operation statuses related to the detection of the object Ob1. The cancelation conditions for the detection item include, as an example, that the same object Ob1 is detected a plurality of times in the at-stop detection result, that the object Ob1 is moving in the direction approaching the machine body 30, that the object Ob1 is present in a specific position around the machine body 30 (for example, a position in the operator's blind spot, or a position within a certain distance from the machine body 30), or that a detection measure (camera and the like) is abnormal (broken). The abnormality in the detection measure includes an abnormality (malfunction or the like) of any of the left camera 341, the right camera 342, the rear camera 343, or an illuminating device that illuminates the monitor area A1, which means that the object Ob1 cannot be detected normally.

The "operation item" here includes various items related to the operation state of the work machine 3, for example, an operation state specific to the operation unit 35. The cancelation condition for the operation item includes, as an example, an emergency stop operated in the operation unit 35, an emergency operation leading to a sudden drive of the work machine 3 or a sudden stop of the work machine 3 in the operation unit 35, or the human operator's hand away from the operation lever of the operation unit 35.

That is, in the limit state, the cancelation process unit 16 is triggered with the above detection item and/or the above operation item meeting the cancelation condition thereby to end the limit state, and switches the state of the work machine 3 (or control system 1) to the state incapable of operating the work machine 3. In the present embodiment, as one example, the determination process unit 13 performs the determination as to whether or not the cancelation condition is met, and the cancelation process unit 16 receives the determination result on the cancelation condition in the determination process unit 13 thereby to execute the cancelation process to end the limit process. Here, the cancelation condition is only required to be determined for at least one of the detection item and the operation item; the cancelation condition may be set only for the detection item, only for the operation item, or for both the detection item and the operation item. In the case where the cancelation condition is set for both the detection item and the operation item, the cancelation process unit 16 may end the limit state if the cancelation condition for at least any one of the detection item and the operation item is met, or may end the limit state only when the cancelation condition for both the detection item and the operation item is met.

In addition, the cancelation process unit 16 forcibly ends the limit state not only when the detection item and/or the operation item meets the cancelation condition, but also when an allowable time has elapsed since the start of the limit state. That is, the limit state ends when the allowable time elapses. Then, in the present embodiment, as one example, even when the allowable time has elapsed, the process, after the end of the limit state, transitions to the state incapable of operating the work machine 3. The "allowable time" here is the upper limit of time for which the limit state can be sustained, and may be a fixed time set regardless of the operation state of the work machine 3, or may be a variable time length that varies depending on the operation content of the work machine 3 (for example, the motion speed of the hydraulic actuator). Also, the cancelation process unit 16 may advance the count of the allowable time only while the work machine 3 is actually operating, and may stop the count of the allowable time while the work machine 3 is stopped. In the present embodiment, as one example, the allowable time should be a fixed time (for example, 1, 2, 5 seconds or the like).

3. Method of Controlling Work Machine

Hereinafter, an example of a method of controlling the work machine 3 (hereinafter, simply referred to as a "control method") mainly executed by the control system 1 will be described with reference to FIG. 5 to FIG. 7.

The control method according to the present embodiment is executed by the control system 1 mainly constituted by the computer system, and in other words, the control method is embodied in a work machine control program (hereinafter, simply referred to as "control program"). That is, the control program is a computer program for causing one or more processors to execute each process associated with the control method. The above control program may be cooperatively executed by, for example, the control system 1 and the display unit 2.

Here, when a specific start operation set in advance so as to cause the control program to be executed, the control system 1 executes the following various types of processes associated with the control method. The start operation is, for example, a startup operation (ignition on) of the engine 40 of the work machine 3. Meanwhile, when a specific end operation set in advance is executed, the control system 1 ends the various types of processes associated with the control method. The end operation is, for example, a stop operation (ignition off) of the engine 40 of the work machine 3.

3.1. Schematic Motion

Figure 5:
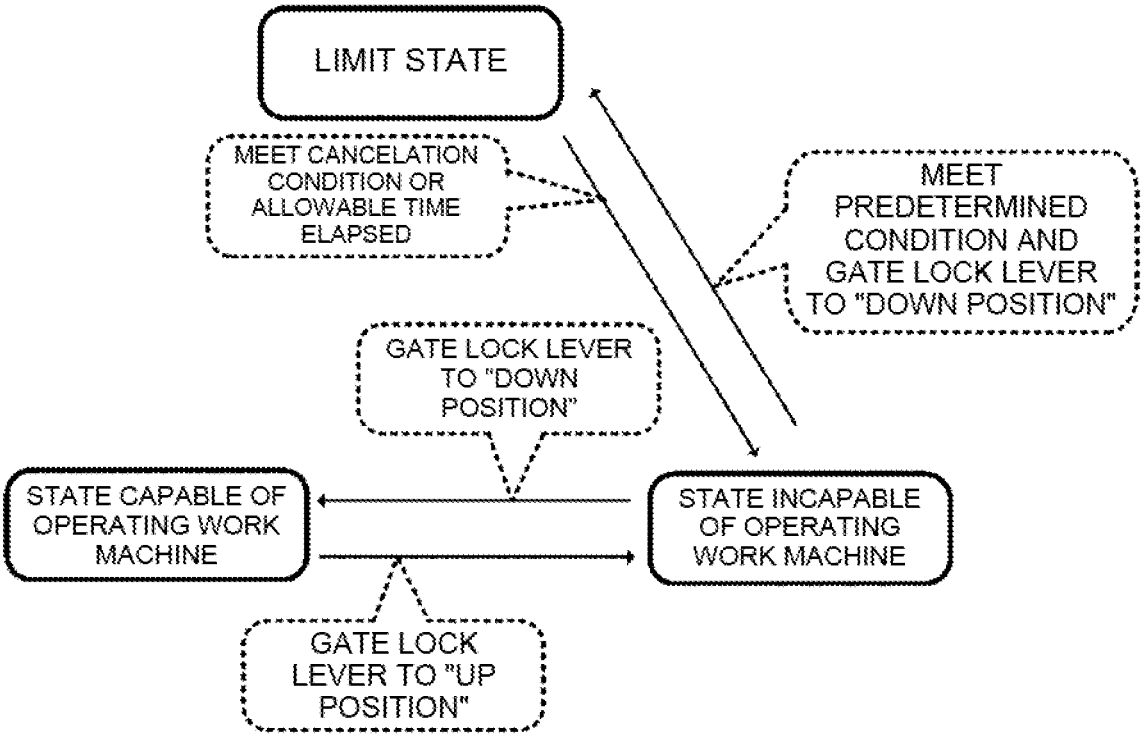
FIG. 5 is a diagram showing a schematic motion of the work machine control system according to the first embodiment.

Here, first, the control method according to the present embodiment, that is, a general motion of the control system 1 according to the present embodiment will be described, with reference to FIG. 5. If it is so considered that there are three states (modes) of the work machine 3 (or control system 1): "the state incapable of operating the work machine 3", "the state capable of operating the work machine 3", and "the limit state", these three modes transition as shown in FIG. 5. Strictly speaking, the "limit state"

is also a kind of "the state capable of operating the work machine 3" in which the gate lock lever 463 is in "down position", but FIG. 5 distinguishes "the state capable of operating the work machine 3" from "the limit state".

The control method according to the present embodiment assumes that the gate lock lever 463 is in "up position" and the gate lock switch 462 is off, and thereby the object Ob1 around the machine body 30 can be detected even in the state incapable of operating the work machine 3. That is, the gate lock lever 463 in "up position"" creates the state incapable of operating the work machine 3, but the detection process unit 14 of the control system 1 continues the process of detecting the object Ob1 around the machine body 30.

Here, the control method according to the present embodiment has acquiring the detection result of the object Ob1 around the machine body 30 of the work machine 3 in the state incapable of operating the work machine 3, and creating the limit state capable of limitedly operating the work machine 3, when the detection result meets a predetermined condition and then the lever 463 is so operated as to create the state capable of operating the work machine 3. That is, when the gate lock lever 463 is in "up position" and the work machine 3 cannot be operated, the acquisition process unit 11 of the control system 1 acquires the detection result of the object Ob1 around the machine body 30 (at-stop detection result). If the gate lock lever 463 is operated from "up position" to "down position" when this detection result meets the predetermined condition, the limit process unit 12 of the control system 1 creates the limit state capable of limitedly operating the work machine 3.

The control method of the present embodiment further has the following: in the limit state, when at least one of the detection item related to the (at-stop) detection result and the operation item related to the operation state of the work machine 3 meets the cancelation condition, the limit state is ended. That is, the cancelation process unit 16 of the control system 1 ends the limit state when at least one of the detection item and the operation item meets the cancelation condition. Further, the limit state also ends when the allowable time has elapsed, so even if the cancelation condition is not met, the limit state ends when the allowable time elapses after the start of the limit state. After the end of the limit state, the process transitions to the state incapable of operating the work machine 3.

As a result, when the gate lock lever 463 is operated to "up position" in "the state capable of operating the work machine 3", the state (mode) of the work machine 3 (or the control system 1) transitions to "the state incapable of operating the work machine 3". Conversely, when the gate lock lever 463 is operated to "down position" in "the state incapable of operating the work machine 3" without the detection result meeting the predetermined condition, the state (mode) of the work machine 3 (or the control system 1) transitions to "the state capable of operating the work machine 3".

When the detection result meets the predetermined condition and the gate lock lever 463 is operated to "down position" in "the state incapable of operating the work machine 3", the state (mode) of the work machine 3 (or control system 1) transitions to the "limit state". In the "limit state", when at least one of the detection item and the operation item meets the cancelation condition or the allowable time elapses, the "limit state" ends, and the state (mode) of the work machine 3 (or the control system 1) transitions to "the state incapable of operating the work machine 3".

3.2. Display Screen

Next, the configuration of the display screen Dp1 shown on the display unit 23 of the display unit 2 by the control method according to the present embodiment will be described with reference to FIG. 6. In the drawings showing the display screen Dp1 displayed on the display unit 23 of the display unit 2, such as FIG. 6, dashed-dotted lines, leading lines, and reference numerals showing regions are merely for illustrative purposes and are not actually displayed on the display unit 2.

Figure 6:
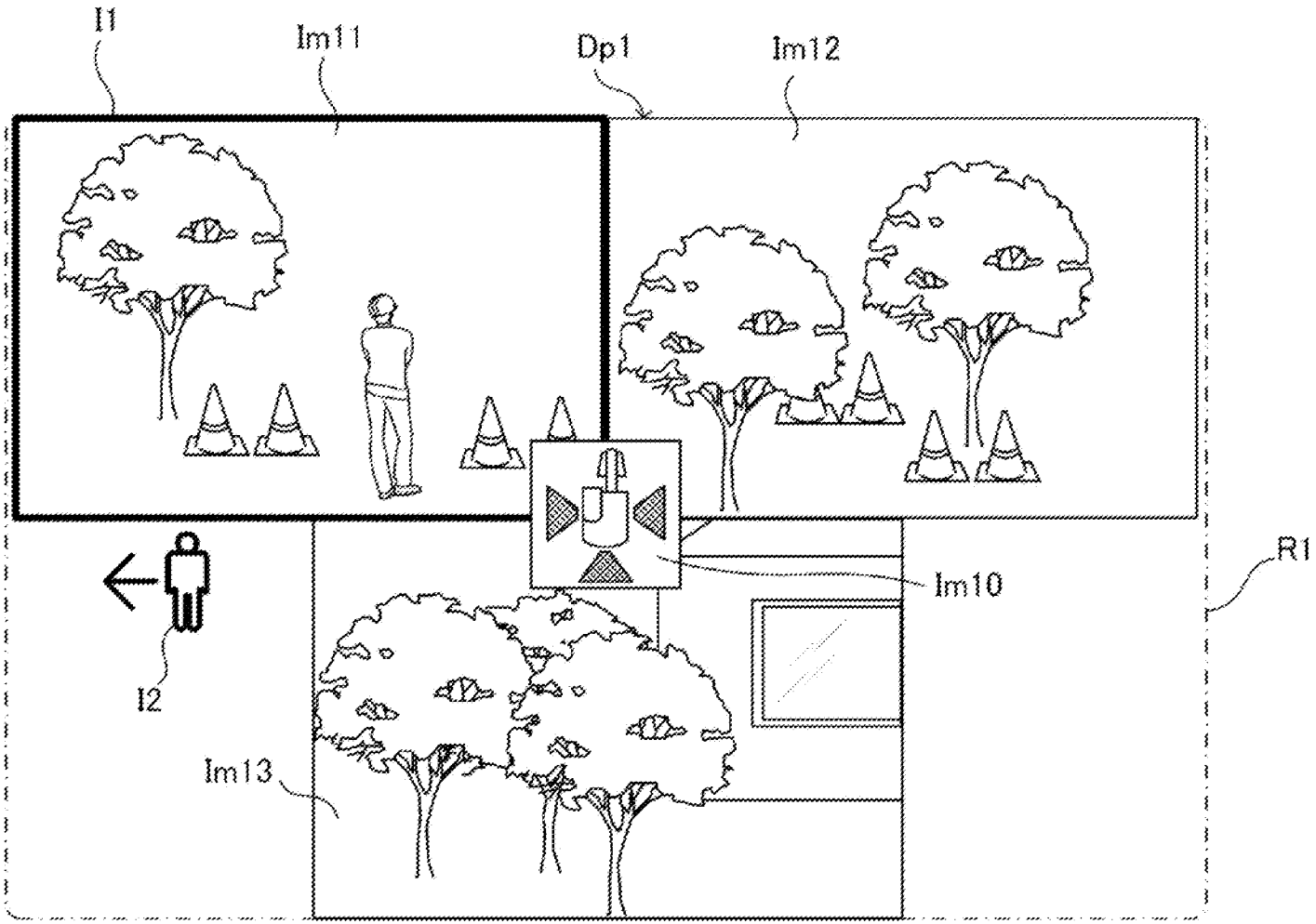
FIG. 6 shows an example of the display screen displayed by the work machine control system according to the first embodiment.

As shown in FIG. 6, the display screen Dp1 displays captured images Im11, Im12, Im13 of the monitor area A1, and detection result information I1 and I2 and the like showing the detection result of the detection process unit 14. In FIG. 6, only a region R1 where the captured images Im11, Im12, Im13 and the like, of monitor area A1, of the display screen Dp1 is shown, and any region other than the region R1 is omitted. The captured image Im11 is an image of the small area A11 that is captured by the left camera 341 and that is on the left of the drive unit 321, and the captured image Im12 is an image of the small area A12 that is captured by the right camera 342 and that is on the right of the drive unit 321. The captured image Im13 is an image of the small area A13 that is captured by the rear camera 343 and that is behind the drive unit 321.

The control system 1 causes the captured images Im11, Im12, Im13, which are acquired by the detection process unit 14, to be displayed in real time. An icon Im10, which imitates the machine body 30 as seen from the information, is displayed in the center portion of the region R1. The icon Im10 schematically shows the positional relation among the imaging areas (small areas A11, A12, and A13) of the left camera 341, the right camera 342 and the rear camera 343 as seen from the machine body 30.

The detection result information Ti is a band-shaped (frame-shaped) graphical image that highlights the captured image containing the object Ob1, of the captured images Im11, Im12, Im13. The detection result information I2 is a graphical image showing the direction in which the object Ob1 is present from the viewpoint of the drive unit 321. The example in FIG. 6 assumes a case where the object Ob1 (in this case, "person") is present in the small area A11 that is captured by the left camera 341 and that is on the left of the drive unit 321. Therefore, of the captured images Im11, Im12, Im13, the captured image Im11 is highlighted in the detection result information Ti; and the detection result information I2 showing the object Ob1 present on the left of the drive unit 321 is displayed below the captured image Im11.

The display mode of the detection result information I1 and I2 is preferably changed according to the position of the object Ob1 in the monitor area A1. For example, the display mode of the detection result information I1 and I2, such as display color, size, or display pattern (including blinking pattern and the like), is changed according to the position of the object Ob1 in the monitor area A1. For example, the closer the object Ob1 is to the machine body 30, the more prominent the display color of the detection result information I1 and I2; as an example, the object Ob1 approaching the machine body 30 changes the display color of the detection result information I1 and I2 from yellow to red.

Thus, the display screen Dp1 not only displays the captured images Im11, Im12, Im13 of the monitor area A1, but also displays the detection result of the object Ob1 in the monitor area A1 as the detection result information I1 and I2. Therefore, the human operator (user U1), by viewing the display screen Dp1, can easily check whether or not the object Ob1 is present in the monitor area A1. Therefore, on the display screen Dp1 displayed on the display unit 2, the human operator (user U1) can check the situations at the work machine 3's sides and rear which are likely to be blind spots from the drive unit 321. Therefore, compared to the configuration in which only the detection result information I1 and I2 are displayed; when the object Ob1 is present in the monitor area A1, it is easier to grasp in detail the situation of the object Ob1 on the display screen Dp1.

3.3. Specific Operation

Next, details of the control method, i.e., a specific motion of the control system 1, are described with reference to a flowchart in FIG. 7.

When the gate lock lever 463 is in "down position" and in "the state capable of operating the work machine 3", the control system 1 can operate the work machine 3 according to the operation of the operation unit 35 without any particular limit on the motion of the work machine 3. Meanwhile, when the gate lock lever 463 is operated from "down position" to the "up position", the control system 1 starts the processes as shown in the flowchart in FIG. 7.

Figure 7:
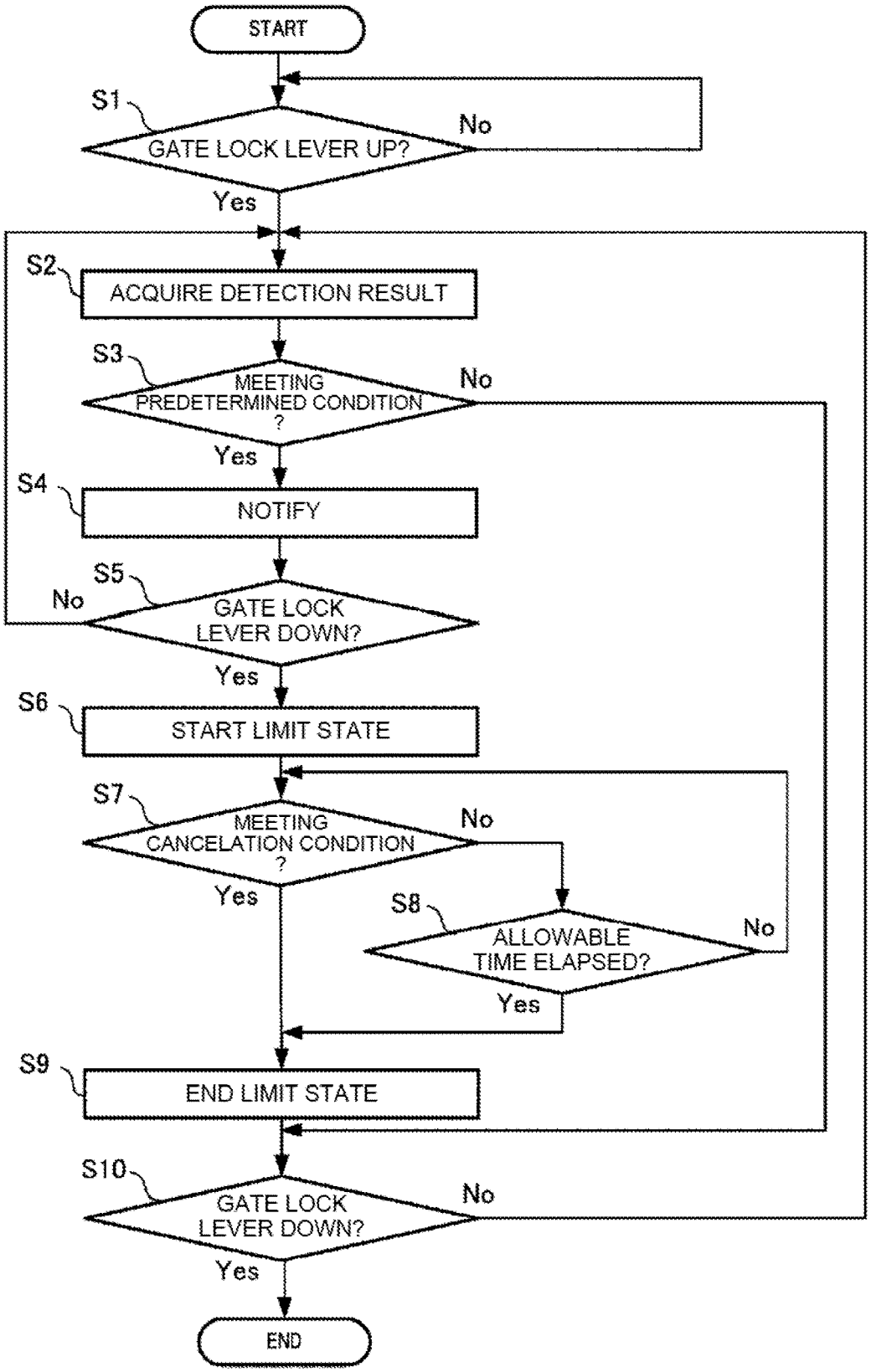
FIG. 7 is a flowchart showing a motion example of the work machine control system according to the first embodiment.

That is, as shown in FIG. 7, when the gate lock lever 463 is operated from "down position" to "up position" as a trigger (S1: Yes), the control system 1 starts the processes from step S2 onward. Here, the determination process unit 13 of the control system 1 determines whether the gate lock lever 463 is in "up position" or "down position" by the gate lock switch 462 on or off, and therefore determines, by the gate lock switch 462 switched from on to off, that the gate lock lever 463 is operated to "up position" (S1: Yes). Here, when the gate lock lever 463 is brought to "up position", the gate lock switch 462 is turned off and the first control valve 461 of the first limit unit 46 on the primary pressure side of the pilot oil path is shut off, causing "the state incapable of operating the work machine 3".

In step S2, from the detection process unit 14, the acquisition process unit 11 of the control system 1 acquires the detection result of the object Ob1 around the machine body 30. That is, based on the outputs of the left camera 341, the right camera 342 and the rear camera 343, the detection process unit 14 outputs a detection result showing whether or not the object Ob1 is present in the monitor area A1. The acquisition process unit 11 acquires the (at-stop) detection result from the detection process unit 14.

In step S3, the determination process unit 13 of the control system 1 determines whether or not the at-stop detection result meets the predetermined condition. At this time, when the object Ob1 (in this case, a "person") is present in the monitor area A1, the determination process unit 13 determines that the at-stop detection result meets the predetermined condition (S3: Yes), and moves the process to step S4. Meanwhile, when the object Ob1 (in this case, a "person") is not present in the monitor area A1, the determination process unit 13 determines that the at-stop detection result does not meet the predetermined condition (S3: No), and moves the process to step S10.

In step S4, the notification process unit 15 of the control system 1 notifies the detection result of the detection process unit 14, i.e., that the object Ob1 is present in the monitor area A1 around the machine body 30. At this time, the notification process unit 15 causes the display unit 23 of the display unit 2 to display the detection result information I1 and I2 (see FIG. 6), and causes the sound output unit 36 to output the notification sound. Thus, the human operator (user U1) can recognize the object Ob1 present around the machine body 30.

However, when the gate lock lever 463 is in "up position", i.e., "the state incapable of operating the work machine 3", the notification process unit 15 does not have to output the notification sound by the sound output unit 36, for example. This allows the human operator (user U1) to recognize the object Ob1 present around the machine body 30, but is freed from the annoyance caused by the notification sound.

Step S5 determines whether or not the gate lock lever 463 is operated from "up position" to "down position". At this time, the determination process unit 13 of the control system 1 determines whether the gate lock lever 463 is in "up position" or "down position" by the gate lock switch 462 on or off, and therefore, determines, by the gate lock switch 462 switched from off to on, that the gate lock lever 463 is operated to "down position" (S5: Yes), and moves the process to step S6. Meanwhile, when determining that the gate lock lever 463 is not operated to "down position" (S5: No), the determination process unit 13 moves the process to step S2.

In step S6, the limit process unit 12 of the control system 1 executes the limit process, and starts the limit state capable of limitedly operating the work machine 3. That is, when the detection result (at-stop detection result) acquired in the state incapable of operating the work machine 3 meets the predetermined condition (S3: Yes), when the gate lock lever 463 is operated so that the work machine 3 can be operated (S5: Yes), the limit process unit 12 creates the limit state capable of limitedly operating the work machine 3.

In this case, the limit process unit 12 may create the state capable of operating the work machine 3 only within a certain time period as the limit state; the present embodiment, however, creates the state capable of operating the work machine 3 after imposing a limit on the motion itself of the work machine 3. That is, in the limit state, the work machine 3 is operated in the state where the motion mode of the work machine 3 is limited. This allows the work machine 3 to operate carefully compared to a configuration in which the work machine 3 operates fully only within the certain time period. Therefore, it is easier to prevent the work machine 3 from being closer or having contact to or with the object Ob1 present around the machine body 30.

More in detail, in the limit state, at least the motion speed of the work machine 3 is limited. That is, according to the present embodiment, the limit process unit 12 realizes the limit state by slowing down at least the motion speed of the work machine 3 (such as the hydraulic actuator) as the motion mode of the work machine 3. For example, when the motion speed of the work machine 3 varies according to the operation rate of the operation lever of the operation unit 35; for the same operation rate, the limit process unit 12 as a whole limits the motion speed of the work machine 3 to several tens of % (as an example, 20% or 50%) relative to the ordinary motion speed of the work machine 3. This prohibits a sudden motion of the work machine 3, making it easier to prevent the work machine 3 from being closer or having contact to or with the object Ob1 present around the machine body 30. In addition, the motion speed of the work machine 3 is slower than normal, which also serves to alert the human operator (user U1) to the object Ob1 being present around the machine body 30.

Specifically, the motion speed is limited by controlling at least one of the flowrate of the hydraulic pump 41 that supplies the hydraulic oil, the speed of the engine 40 that drives the hydraulic pump 41, and the pilot pressure. According to the present embodiment, in step S6, the limit process unit 12 controls at least one of the flowrate of the hydraulic pump 41, the speed of the engine 40 that drives the hydraulic pump 41, and the pilot pressure, thereby to limit the motion speed of the work machine 3 and creates the limit state.

That is, the limit process unit 12 controls the solenoid proportional valve 492 of the flowrate limit unit 49 thereby to decrease the pilot pressure input to the control signal input port 491 and to decrease an inclination angle of a swash plate of the hydraulic pump 41. As the inclination angle of the swash plate of the hydraulic pump 41 decreases, the discharge rate (flowrate) of the hydraulic oil of the hydraulic pump 41 decreases, and the motion speed of the hydraulic actuator driven by the hydraulic oil decreases. If the hydraulic pump 41 is a variable displacement pump, such control allows the limit process unit 12 to easily decrease the motion speed of the work machine 3.

Similarly, the limit process unit 12 controls the speed of the engine 40 by the engine control unit 493 of the flowrate limit unit 49, making it possible to decrease the speed of the engine 40 (speed of hydraulic pump 41). As a result, when the speed of the hydraulic pump 41 decreases, the discharge rate (flowrate) of the hydraulic oil of the hydraulic pump 41 decreases, and the motion speed of the hydraulic actuator driven by the hydraulic oil decreases. In short, switching the speed of the engine 40 from high idle speed to low idle speed allows the limit process unit 12 to easily decrease the motion speed of the work machine 3. Further, in this case, the fluctuation of a noise of the engine 40 can also alert the human operator (user U1) to the object Ob1 being present around the machine body 30.

Similarly, the limit process unit 12 controls the second control valve 471 of the second limit unit 47 thereby to decrease the flowrate of the pilot oil supplied from the pilot pump 42 to the remote control valve 45, making it possible to decrease the pilot pressure. As the pilot pressure decreases (depressurizes), an opening amount of a spool of the direction switch valve 48 decreases; when the control of the hydraulic pump 41 is LS (Load Sensing) control, the decrease in the opening amount of the spool decreases the flowrate of the hydraulic pump 41 so as to maintain the LS differential pressure constant, and the motion speed of the hydraulic actuator driven by the hydraulic oil decreases. Even when the control of the hydraulic pump 41 is negative control; together with the decrease in the opening of the spool, an opening of a spool to an open center flow path leading to a tank increases, thus increasing a negative control pressure detected downstream. As a result, the flowrate of the hydraulic pump 41 decreases, and the motion speed of the hydraulic actuator driven by the hydraulic oil decreases. Further, in the case of positive control; even in the following situation: the gate lock lever 463 is in "up position", the operation of the operation unit 35 is detected, the flowrate of the hydraulic pump 41 is decreased, and the gate lock lever 463 is operated to "down position", for example, decrease in the flowrate of the hydraulic pump 41 is maintained. With of the above control, the limit process unit 12 can easily decrease the motion speed of the work machine 3.

In step S7, the determination process unit 13 of the control system 1 determines whether or not at least one of the detection item and the operation item meets the cancelation condition. At this time, if there is an abnormality in the detection measure such as the left camera 341, right camera 342 or rear camera 343, for example, leading to a state where the object Ob1 cannot be ordinarily detects, the determination process unit 13 determines that the detection item meets the cancelation condition (S7: Yes) and moves the process to step S9. Meanwhile, when both of the detection item and the operation item fail to meet the cancelation condition (S7: No), the determination process unit 13 moves the process to step S8.

In step S8, the cancelation process unit 16 of the control system 1 determines whether or not the allowable time has elapsed from the start of the limit state (S6). At this time, the cancelation process unit 16 compares the elapsed time from the start of the limit state (S6) with the allowable time; if the elapsed time has reached the allowable time, the cancelation process unit 16 determines that the allowable time has elapsed (S8: Yes), and moves the process to step S9. Meanwhile, if the elapsed time has not reached the allowable time, the cancelation process unit 16 determines that the allowable time has not elapsed (S8: No), and moves the process to step S7.

In step S9, the cancelation process unit 16 of the control system 1 ends the limit state. That is, after the start of the limit state (S6), depending on whether the detection item and/or the operation item meets the cancelation condition (S7: Yes), or based on that the allowable time elapses (S8: Yes), the cancelation process unit 16 ends the limit state. At this time, the cancelation process unit 16 cancels the limit process unit 12's limiting on the motion mode (motion speed) of the work machine 3. Specifically, when the limit process unit 12 is decreasing the flowrate of the hydraulic pump 41, the cancelation process unit 16 increases the flowrate of the hydraulic pump 41 (for example, to the maximum value). When the limit process unit 12 is decreasing the speed of the engine 40, the cancelation process unit 16 increases the speed of the engine 40; when the limit process unit 12 is decreasing the pilot pressure, the cancelation process unit 16 increases the pilot pressure.

According to the present embodiment; when the limit state ends, the state (mode) of the work machine 3 (or control system 1) transitions to "the state incapable of operating the work machine 3". Therefore, in step S9, although the limit process unit 12's limiting on the motion mode (motion speed) of the work machine 3 is cancelled, the cancelation process unit 16 puts the second control valve 471 of the second limit unit 47 in a shut-off state, for example, to thereby create "the state incapable of operating the work machine 3". That is, when the second control valve 471 is in the shut-off state, even if the gate lock lever 463 is in "down position", "the state incapable of operating the work machine 3" is created same as the gate lock lever 463 being in "up position".

Step S10 determines whether or not the gate lock lever 463 has been operated from "up position" to "down position". At this time, the determination process unit 13 of the control system 1 determines whether the gate lock lever 463 is in "up position" or "down position" by the gate lock switch 462 on or off, and therefore determines, by the gate lock switch 462 switched from off to on, that the gate lock lever 463 is operated to "down position" (S10: Yes), and ends the series of processes by creating "the state capable of operating the work machine 3". Meanwhile, when determining that the gate lock lever 463 is not operated to "down position" (S10: No), the determination process unit 13 moves the process to step S2.

However, in step S10 in the case where the predetermined condition is determined to be met (S3: Yes), the gate lock lever 463 is already in "down position" (S5: Yes). Therefore, in this case, when the gate lock lever 463 is operated once to "up position" and then to "down position", it is determined that the gate lock lever 463 is operated to "down position" (S10: Yes). Then, the cancelation process unit 16 puts the second control valve 471 of the second limit unit 47 in the open state, thereby switching from "the state incapable of operating the work machine 3" to "the state capable of operating the work machine 3".

The control system 1 repeatedly executes the processes in step S1 to step S10. However, the flowchart shown in FIG. 7 merely constitutes one example, and therefore, the process may appropriately be added or omitted, or the order of the processes may appropriately be changed.

As described above, the control method according to the present embodiment has acquiring the detection result of the object Ob1 around the machine body 30 of the work machine 3 in the state incapable of operating the work machine 3, and creating the limit state capable of limitedly operating the work machine 3, when the detection result meets the predetermined condition and then the gate lock lever 463 is so operated as to create the state capable of operating the work machine 3. Thus, even if the gate lock lever 463 is switched to the unlocked state (down position), the object Ob1 being present around the machine body 30, for example, creates the limit state capable of limitedly operating the work machine 3. Therefore, even when the object Ob1 is present around the machine body 30; with the gate lock lever 463 operated to the unlocked state (down position), the work machine 3 can be operated for the time being. Further, without the human operator (user U1) having to take special care, it is easier to avoid problems such as sudden and vigorous motion of the work machine 3, for example. As a result, it is possible to provide the work machine control system 1, the work machine 3, the method of controlling the work machine 3, and the work machine control program which easily decrease the burden on the human operator related to the operation.

According to the present embodiment, at least one of the detection item related to the detection result and the operation item related to the operation state of the work machine 3, when meeting the cancelation condition in the limit state, ends the limit state. Thus, meeting the specific cancelation condition can forcibly end the limit state. In addition, according to the present embodiment, the limit state ends when the allowable time has elapsed. Thus, the limit state does not last forever, but the limit state is to be applied at least under a time limit. According to the present embodiment, after the end of the limit state, the process transitions to the state incapable of operating the work machine 3. Therefore, when it is unpreferable to continue the motion of the work machine 3 even in the limit state, such as an abnormality in the detection measure, the work machine 3 can be forcibly stopped after the end of the limit state.

4. Modified Examples

A description will hereinafter be made on modified examples of the first embodiment. The modified examples, which will be described below, can be applied in an appropriate combination.

The control system 1 according to the present disclosure includes the computer system. The computer system has, as hardware, one or more processors and one or more memories. The processor, by executing the program recorded in the memory of the computer system, realizes the function as the control system 1 in the present disclosure. The program may be preliminarily recorded in the memory of the computer system, may be provided through an electric communication line, or, on a non-transitory recording medium, such as a memory card, an optical disk, a hard disk drive, or the like, that is readable by the computer system, may be recorded and then provided. Further, a part of or all the functional portions included in the control system 1 may be composed of an electronic circuit.

A configuration in which at least a part of the functions of the control system 1 is integrated in one case is not essential and the components of the control system 1 may be provided in a plurality of cases in a distributed manner. Conversely, functions that are distributed to a plurality of devices (such as the control system 1 and the display unit 2) in the first embodiment may be integrated in one case. Further, at least a part of the functions of the control system 1 may be realized by a cloud (cloud computing) or the like.

The power source of the work machine 3 is not limited to the diesel engine, but may be, for example, the engine 40 other than the diesel engine, a motor (an electric motor), or a hybrid power source that includes the engine 40 and the motor (electric motor).

The display unit 2 is not limited to a dedicated device, but may be a general-purpose terminal, such as a laptop computer, a tablet terminal, or a smartphone. Further, the display unit 23 is not limited to a mode in which a display screen is directly displayed, such as a liquid crystal display or an organic EL display, but may be a configuration that displays the display screen by projection, such as a projector.

Further, as a mode for inputting information on the operation unit 22, a mode other than the push button switch, the touch screen, and the operation dial may also be employed. For example, the operation unit 22 may employ modes of input, such as a keyboard, a pointing device such mouse, a voice input, a gesture input, or an operation signal from another terminal.

The limit state can be any state as long as being capable of limitedly operating the work machine 3, and is not limited to a state limiting the speed of the motion (traveling, switching and the like) of the work machine 3. For example, the limit state may be a state capable of operating the work machine 3 only within the certain time period, a state capable of operating the work machine 3 only within the certain distance, a state where the moveable range of the hydraulic actuator is limited, a state where the operation target (such as a specific hydraulic actuator) is limited, and a state where the certain operation such as swiveling and expanding of the work machine 3 are prohibited, or a combination of these states and the like.

The sensors for detecting the object Ob1 in the monitor area A1 around the machine body 30 may include, without limitation, the left camera 341, the right camera 342 and the rear camera 343, and may include one, two or four or more cameras (image sensors). Further, for example, a camera that can capture images in all directions as seen from the work machine 3, such as a 360-degree camera, may be used to detect the object Ob1 in the monitor area A1. The sensors for detecting the object Ob1 in the monitor area A1 may include, in addition to or instead of the camera, for example, a motion sensor, a sonar sensor, a radar or LiDAR (Light Detection and Ranging) or the like. The sensor that detects the object Ob1 in the monitor area A1 may be a 3-dimension sensor that measures the distance to the object Ob1 by the TOF (Time Of Flight) method that measures the distance to the distance measurement point based on the round trip time from the arrival of light or sound at the distance measurement point to its return.

The detection process unit 14, which detects the object Ob1 around the machine body 30, is not a component essential to the control system 1. For example, the detection process unit 14 may be included in a detection system other than the control system 1; in this case, the acquisition process unit 11 of the control system 1 acquires, from outside (detection system) of the control system 1, the detection result of the object Ob1 around the machine body 30 of the work machine 3.

The object Ob1 may include, in addition to or instead of a "person", a mobile object such as a vehicle (including other work machine), structures such as walls and pillars, plants, animals, steps, ditches, or other obstacles.

It is not essential to move the work machine 3 in the limited state limiting the motion mode of the work machine 3. That is, in the limit state, the work machine 3 may perform all possible motions only within the certain time period, for example. It is not essential that at least the motion speed of the work machine 3 should be limited in the limit state. In addition, it is not essential to limit the motion speed by controlling at least one of the flowrate of the hydraulic pump 41 that supplies the hydraulic oil, the speed of the engine 40 that drives the hydraulic pump 41, and the pilot pressure.

In the limit state, it is not essential to end the limit state when at least one of the detection item related to the detection result and the operation item related to the operation state of the work machine 3 meets the cancelation condition. It is also not essential that the limit state should end after the allowable time has elapsed. It is not essential to perform the transition, after the end of the limit state, to the state incapable of operating the work machine 3. In addition, it is not essential that the notification process unit 15 should provide the notification that is based on the detection result of the detection process unit 14, i.e., based on the detection result of the object Ob1 in the monitor area A1 around the machine body 30.

Second Embodiment

Figure 8:
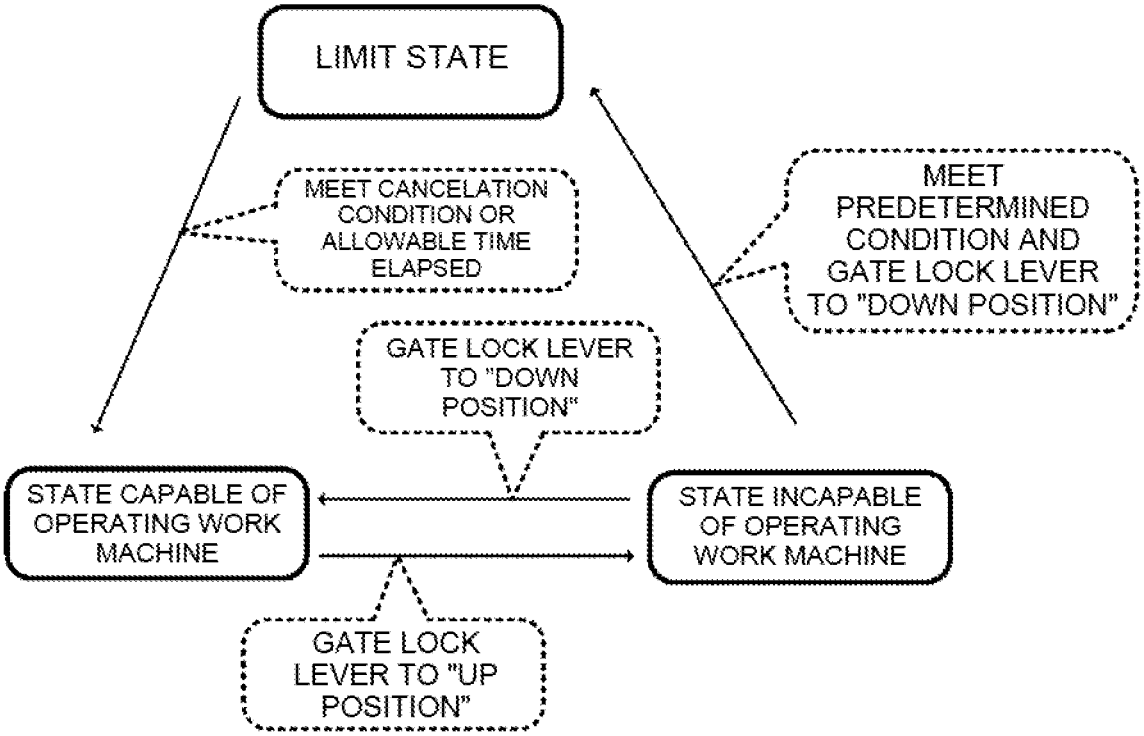
FIG. 8 shows a diagram showing a schematic motion of the work machine control system according to a second embodiment.

As shown in FIG. 8, the control system 1 according to the present embodiment differs from the control system 1 according to the first embodiment in that the former performs the transition, after the end of the limit state, to the state capable of operating the work machine 3. Hereinafter, the same components as those in the first embodiment will be denoted by the same reference signs, and the description thereof will appropriately be omitted.

That is, in the present embodiment, when the detection item and/or the operation item meets the cancelation condition, or when the allowable time has elapsed from the start of the limit state and the limit state has ended, the process transitions to "the state capable of operating the work machine 3" instead of "the state incapable of operating the work machine 3". Therefore, when the detection result meets the predetermined condition in "the state incapable of operating the work machine 3", the human operator merely needs to once operate the gate lock lever 463 from "up position" to "down position" (S5: Yes in FIG. 7), then the process automatically transitions to "the state capable of operating the work machine 3" through the limit state. This allows that at least the allowable time having elapsed after the start of the limit state switches the process to "the state capable of operating the work machine 3" without the need of the human operator operating the gate lock lever 463 again.

As a modified example of the second embodiment, only when the allowable time has elapsed from the start of the limit state, the process may be transitioned to "the state capable of operating the work machine 3" after the end of the limit state. That is, when the limit state is ended by the detection item and/or the operation item meeting the cancelation condition, the process transitions to "the state capable of operating the work machine 3" as in the first embodiment.

The configuration (including the modified example) according to the second embodiment can be employed in appropriate combination with the various configurations (including the modified example) described in the first embodiment.

REFERENCE SIGNS LIST

1: work machine control system
2: display unit
3: work machine
11: acquisition process unit
12: limit process unit
30: machine body
40: engine
41: hydraulic pump
463: gate lock lever
Ob1: object

The invention claimed is:

1. A work machine control system, comprising:

an acquisition process unit configured to acquire a detection result of an object in an area around a machine body of a work machine while the work machine is in a first state in which the work machine is incapable of operating; and a limit process unit configured to, while the work machine is in the first state, transition the work machine to a limit state in which the work machine is capable of limitedly operating, wherein the limit process unit transitions the work machine when the detection result meets a predetermined condition and then a gate lock lever is so operated to a position associated with a second state in which the work machine is capable of operating, wherein the predetermined condition includes the object being present in the area.

2. The work machine control system according to claim 1, wherein, in the limit state, the work machine is configured to be operated in a state where a motion mode of the work machine is limited.

3. The work machine control system according to claim 2, wherein, in the limit state, at least a motion speed of the work machine is limited.

4. The work machine control system according to claim 3, wherein at least one of flowrate of a hydraulic pump that supplies a hydraulic oil, a speed of an engine that drives the hydraulic pump, or a pilot pressure is configured to be controlled to limit the motion speed.

5. The work machine control system according to claim 1, wherein, when at least one of a detection item related to the detection result or an operation item related to an operation state of the work machine meets a cancelation condition in the limit state, the limit state is ended.

6. The work machine control system according to claim 1, wherein the limit state ends when an allowable time has elapsed.

7. The work machine control system according to claim 1, wherein, after the limit state ends, a process transitions to the first state.

8. The work machine control system according to claim 1, wherein the limit state comprises:

operating the work machine within a pre-determined time;

operating the work machine within a pre-determined distance;

limiting a motion or speed of the work machine;

limiting an operation target of the work machine;

inhibiting one or more operations of the work machine; or a combination thereof.

9. A work machine, comprising:

the work machine control system according to claim 1; and the machine body.

10. A method of controlling a work machine, comprising:

acquiring a detection result of an object in an area around a machine body of a work machine while the work machine is in the first state in which the work machine is in a state incapable of operating; and creating a limit state, while the work machine is in the first state, configured to transition the work machine to a limit state in which the work machine is capable of limitedly operating wherein the limit process unit transitions the work machine when the detection result meets a predetermined condition and then a gate lock lever is so operated to a position associated with a second state in which the work machine is capable of operating, wherein the predetermined condition includes the object being present in the area.

11. A non-transitory, computer readable medium storing a work machine control program, which when executed by one or more processors, causes the one or more processors to perform operations including:

acquiring a detection result of an object in an area around a machine body of a work machine while the work machine is in the first state in which the work machine is incapable of operating; and creating while the work machine is in the first state, configured to transition the work machine to a limit state capable of limitedly operating, wherein the limit process unit transitions the work machine when the detection result meets a predetermined condition and then a gate lock lever is so operated to a position associated with a second state in which the work machine is capable of operating the work machine, wherein the predetermined condition includes the object being present in the area.

12. The method according to claim 10, wherein the limit state comprises:

operating the work machine within a pre-determined time;

operating the work machine within a pre-determined distance;

limiting a motion or speed of the work machine;

limiting an operation target of the work machine;

inhibiting one or more operations of the work machine; or a combination thereof.

* * * * *